US009511491B2

(12) United States Patent
Brunner

(10) Patent No.: US 9,511,491 B2
(45) Date of Patent: Dec. 6, 2016

(54) TOOLBOX

(71) Applicant: KETER PLASTIC LTD., Herzelyia (IL)

(72) Inventor: Yaron Brunner, Timrat (IL)

(73) Assignee: KETER PLASTIC LTD., Herzelyia (IL)

( * ) Notice: Subject to any disclaimer, the term of this patent is extended or adjusted under 35 U.S.C. 154(b) by 0 days.

(21) Appl. No.: 14/655,504

(22) PCT Filed: Dec. 24, 2013

(86) PCT No.: PCT/IL2013/051061

§ 371 (c)(1),
(2) Date: Jun. 25, 2015

(87) PCT Pub. No.: WO2014/102781

PCT Pub. Date: Jul. 3, 2014

(65) Prior Publication Data

US 2015/0352711 A1 Dec. 10, 2015

Related U.S. Application Data

(60) Provisional application No. 61/746,331, filed on Dec. 27, 2012.

(51) Int. Cl.
*B25H 3/00* (2006.01)
*B25H 3/02* (2006.01)
(Continued)

(52) U.S. Cl.
CPC ..... *B25H 3/02* (2013.01); *B25H 3/022* (2013.01); *B65D 25/18* (2013.01); *B65D 43/16* (2013.01); *B65D 43/24* (2013.01)

(58) Field of Classification Search
CPC ..... B65D 25/18; B25H 3/00; B25H 3/02; B25H 3/023
(Continued)

(56) References Cited

U.S. PATENT DOCUMENTS 3,777,882 A * 12/1973 McIntyre ..... B65D 81/1075 206/370
5,235,355 A * 8/1993 May ..... G02C 3/003 351/123
(Continued)

FOREIGN PATENT DOCUMENTS

AU 2009243523 A1 6/2010
DE 86 03 926 U1 4/1986
(Continued)

*Primary Examiner* — King M Chu
(74) *Attorney, Agent, or Firm* — Vorys, Sater, Seymour and Pease LLP

(57) ABSTRACT

Provided is a toolbox including a base member, made of a substantially rigid material, having base side walls extending from a base bottom to a perimetric base rim, and defining together a base interior storage space, said base bottom and base side walls configured with a base interior surface and a base exterior surface; a cover member, made of a substantially rigid material, having a perimetric cover rim, a cover interior surface and a cover exterior surface, said cover rim corresponding in shape and size to fit said base rim; and a liner member having a liner interior surface and a liner exterior surface, said liner member being made of a rigid though pliable material. The liner member is configured to be received within and supported by the base member in a spaced apart relationship therebetween to allow the liner member to be deformed towards the base interior surface.

16 Claims, 13 Drawing Sheets

(51) Int. Cl.
*B65D 25/18* (2006.01)
*B65D 43/24* (2006.01)
*B65D 43/16* (2006.01)

(58) Field of Classification Search
USPC ..... 206/349, 594, 372, 373; 220/810, 816, 220/529, 530, 553
See application file for complete search history.

(56) References Cited

U.S. PATENT DOCUMENTS

| | | | | |
|---|---|---|---|---|
| D467,426 | S | 12/2002 | Hardigg et al. | |
| D612,604 | S | 3/2010 | Horiyama et al. | |
| D639,059 | S | 6/2011 | Fraiman et al. | |
| D674,605 | S | 1/2013 | Vilkomirski et al. | |
| 2003/0062279 | A1 | 4/2003 | Lam | |
| 2005/0121446 | A1 | 6/2005 | Yang | |
| 2007/0272572 | A1 | 11/2007 | Chen | |
| 2009/0321299 | A1* | 12/2009 | Gehring | A47K 10/42 206/581 |
| 2011/0074262 | A1 | 3/2011 | Liu | |
| 2011/0233096 | A1 | 9/2011 | Michels et al. | |
| 2012/0152944 | A1 | 6/2012 | Vilkomirski et al. | |
| 2013/0340653 | A1 | 12/2013 | Patstone | |

FOREIGN PATENT DOCUMENTS

| | | | |
|---|---|---|---|
| EP | 0 383 078 | A1 | 8/1990 |
| EP | 2 308 655 | A2 | 4/2011 |
| EP | 2 319 351 | A1 | 5/2011 |
| WO | 2011/078763 | A1 | 6/2011 |

* cited by examiner

TOOLBOX

TECHNICAL FIELD

This presently disclosed subject matter relates to storage containers, and more particularly to toolboxes.

The term 'toolbox' as used herein the specification and claims is used in its broad sense and refers to any container for organizing, protecting, accommodating, storing, locomoting and displaying articles and/or tools of any kind.

BACKGROUND

Toolboxes and the other similar containers are commonly used in a variety of fields, such as construction, repairs, etc., to store and to transport tools to and from a jobsite or between locations at a jobsite.

Such containers are typically made from plastic or metal, and may be reinforced. In addition, they may comprise a base portion having a cavity to store therewithin tools, and a cover pivotally articulated thereto. Locking means are often provided so that the contents do not spill during transport.

Toolboxes are used primarily by specialized technicians, such as machinist, electricians, and carpenters etc, or by an average user for small repairs at home. Typically, the user of a toolbox carries the toolbox to places outside his workshop, and thus must have all the necessary tools available therein. However, since frequently the toolbox contains a large verity of tools, searching for the right tool might be time consuming, and doing so while working might be quite frustrating. Thus, toolboxes typically are formed with a plurality of compartments, each having a different size and shape adapted to hold certain tools and supplies, and configured for convenient access.

SUMMARY OF THE PRESENTLY DISCLOSED SUBJECT MATTER

According to one aspect the presently disclosed subject matter, there is provided a toolbox comprising:

a base member, made of a substantially rigid material, having base side walls extending from a base bottom to a perimetric base rim, and defining together a base interior storage space, said base bottom and base side walls configured with a base interior surface and a base exterior surface;

a cover member, made of a substantially rigid material, having a perimetric cover rim, a cover interior surface and a cover exterior surface. The cover rim corresponding in shape and size to fit the base rim; and a liner member having a liner interior surface and a liner exterior surface. The liner member is made of a rigid though pliable material.

The liner member is configured to be received within and supported by the base member in a spaced apart relationship between the liner exterior surface and the base interior surface so as to allow the liner member to be deformed towards the base interior surface.

The arrangement is such that upon application of reasonable forces on the liner member, e.g., pressing force generated by a tool accommodated therein, will temporarily deform, however, will assume its original shape upon ceasing of the forces. It should be indicated, that differently from soft materials, e.g., sponge, foamed materials, etc. which tend to squeeze upon application of forces thereon, the material of the liner member according to the disclosed subject matter, substantially does not squeeze, but rather tends to be stretched towards the space between the liner member and the base member.

The liner member can be configured to be received within the base member so that the liner exterior surface partially engages the base interior surface with one or more chambers formed therebetween. Each of the chambers can be configured with a chamber wall, constituted by a corresponding portion of the liner member, configured to be deformed (e.g., bent) towards the base interior surface, thereby reducing the volume of its respective chamber.

The liner member can be formed with compartments or cavities being defined by its structure, for accommodating tools therein.

The toolbox has an open and a closed position. In the open position, the base rim is disengaged from the cover rim, and in the closed position, the base rim is engaged with the cover rim.

The base member and the cover member can be pivotally articulated with each other by means of a hinge.

The cover member can have a unitary structure, or alternatively can be structured of two or more separate segments.

The toolbox can further comprise a restricting mechanism configured to support the cover with respect the base member in the open position of the toolbox.

The restricting mechanism can be further configured to restrict the angle between the cover member and the base member in the open position of the toolbox.

The restricting mechanism can be configured with a stopping element having a pivoting portion pivotally received with a hinge portion of the cover member and at least one sliding end disposed within at least one corresponding recess formed within the base member and configured to slide within the recess between the open and the closed positions of the toolbox.

The recess within the base member can have a longitudinal shape.

The longitudinal recess can have a recess engagement portion on which the respective sliding end rests in the open position of the toolbox.

The liner member can be configured with liner side walls extending from a liner bottom to a perimetric liner rim, defining a liner interior storage space. The liner side walls and the liner bottom can be configured with the liner interior surface and the liner exterior surface.

Alternatively, the liner member can be provided in form of a flat liner base member without side walls.

When the liner member is received within the base member, it can constitute a supporting surface for absorbing and/or reducing shock and noise generated by the tools that are accommodated within the liner interior storage space during transportation of the toolbox in its closed position. This can also keep the tools from being harmed during their transportation, and thereby can increase their life span.

The toolbox can comprise a plurality of supports configured to be disposed between the liner member and the base member for providing the spaced apart relationship between the liner exterior surface and the base interior surface.

The supports can be one or more of the following configurations: protrusions, edges, or any other projecting elements.

The supports can be separate elements disposed between the liner member and the base member.

The supports can be base supports in form of protrusions extending from the base interior surface.

The supports can be liner supports in form of protrusions extending from the liner exterior surface.

The supports can be provided in different configurations of at least one of the following elements: the base supports, the liner supports and the separate elements.

The base supports can have a longitudinal shape.

The base supports can be arranged according to a diagonal pattern.

The base supports can be configured to increase the rigidity of the base member.

The liner supports can have a longitudinal structure.

The liner supports can be configured to engage the base supports and to rest thereon when the liner member is received within the base member.

The liner supports can be configured to engage the base interior surface and to rest thereon when the liner member is received within the base member.

The base supports can be configured to engage the liner exterior surface and to rest thereon when the liner member is received within the base member.

Each of the chambers can be defined by the chamber wall, a corresponding portion of the base interior surface and at least one of the following: the corresponding liner supports and the corresponding base supports.

The liner interior surface can be configured with a plurality of liner recesses configured to receive corresponding dividers for dividing the liner interior storage space into compartments.

Each of the compartments can be configured with at least one corresponding chamber wall disposed at its bottom.

The liner recesses and the liner supports can coincidence with each other, so that each liner recess is a corresponding liner supporting protrusion.

The liner member can further include a plurality of flexible legs extending out of the liner exterior surface, configured to lean on the base interior surface and to provide a support when a force is applied on the liner interior surface.

The liner member can include one or more sockets.

When the liner is configured with a liner rim, the liner rim can securely rest on the base rim. The liner rim can correspond in shape and size to the base rim when the liner member is received within the base member, so that in the closed position of the toolbox, the liner rim is clamped between the base rim and the cover rim, thereby sealing the toolbox.

The liner member can be securely received within the base member in a fixedly or a detachable fashion.

The secure attachments of the liner member to the base member can be provided by a plurality of fasteners connecting therebetween.

When the liner member is received within the base member and its liner rim rests on the base rim, its rigid though pliable material allows the liner rim to constitute a sealing member serving as a gasket for providing the sealing to the toolbox in its closed position.

The liner member of the presently disclosed subject matter can be easily manufactured (e.g., as a single-molded element) and can be easily maintained (e.g., cleaned, washed) in comparison with other liners known in the art. In addition, the liner of the presently disclosed subject matter can be stable for long lasting usage, it doesn't absorb dirt easily, and can be chemically resistant to various substances. The liner can be designed to resist chemical agents which are usually stored within toolboxes or used in working areas.

In the closed position of the toolbox, the above described sealing provides at least one of the following properties to the interior of the toolbox: water-resistance, and water-tightness.

The base rim, the cover rim and the liner rim can be configured with substantially the same contour.

The structure of liner member can correspond in shape and size to the structure of the base member.

The liner rim can comprise a liner rim protrusion configured to be received within a corresponding base rim recess formed within the base rim for mounting the liner member on the base member.

The liner rim can comprise a liner rim recess configured to receive a corresponding base rim protrusion formed with the base rim for mounting the liner member on the base member.

The liner rim can comprise a liner rim upper protrusion configured to engage the cover rim in the closed position of the toolbox.

The material of the liner member can be water impermeable.

The material of the liner member can be Polyethylene.

The material of the liner member can be a combination of a Linear Low-Density (LLD) Polyethylene and a Low-Density (LD) Polyethylene.

The material of the liner member can have a shore A hardness of between about 55 and about 100, and more particularly between about 70 and about 90.

The liner rim can have a greater shore A harness than the rest of the elements of the liner member.

The cover member can be further configured with cover side walls extending from a cover bottom to the perimetric cover rim, and defining together a cover interior storage space. The cover side walls and the cover bottom can be configured with the cover interior surface and the cover exterior surface.

The toolbox can further comprise an additional liner member having an additional liner interior surface and an additional liner exterior surface corresponding in size and shape to the cover interior surface, so as to allow the cover member to receive the additional liner member therein.

The additional liner member can be made of a rigid though pliable material.

The additional liner member can be configured to be received within and supported by the cover member in a spaced apart relationship between the additional liner exterior surface and the cover interior surface so as to allow the additional liner member to be deformed towards the cover interior surface.

The rigidity though pliability of the additional liner member can be such that upon application of reasonable forces, e.g., pressing forces generated by a tool accommodated therein, its original shape will change. When the forces are not applied, e.g., upon removal of the tool, the additional liner member will assume its original shape and position. It should be indicated, that differently from soft material, e.g., sponge, which tend to squeeze upon application of forces thereon, the material of the additional liner member substantially does not squeeze, but rather tends to be stretched towards the space between the liner member and the base member.

The additional liner member can configured to be received within the cover member so that the additional liner exterior surface partially engages the cover interior surface with one or more additional chambers formed therebetween. Each of the additional chambers can be configured with an additional chamber wall, constituted by a corresponding portion of the additional liner member, configured to be deformed (e.g., bent) towards the cover interior surface, thereby compressing the volume of its respective additional chamber.

The additional liner member can be configured with additional liner side walls extending from an additional liner bottom to a perimetric additional liner rim, defining an additional liner interior storage space. The additional liner side walls, the additional liner bottom and the additional liner rim be configured with the additional liner interior surface and the additional liner exterior surface.

Alternatively, the liner member can be provided in form of a flat member without walls.

The additional liner member can be made of the material of the liner member.

Alternatively, the liner member can be provided in form of a flat member without walls.

When the additional liner member is received within the cover member, it can constitute a supporting surface for absorbing and/or reducing shock and noise generated by the tools that are accommodated within the additional liner interior storage space during transportation of the toolbox in its closed position.

The toolbox can comprise a plurality of additional supports configured to be disposed between the additional liner member and the cover member for providing the spaced apart relationship between the additional liner exterior surface and the cover interior surface.

The additional supports can be one of the following: protrusions, edges, or any other projecting elements.

The additional supports can be separate elements disposed between the liner member and the base member.

The additional supports can be cover supports in form of protrusions extending from the cover interior surface.

The cover supports can have a longitudinal shape.

The cover supports can be arranged according to a diagonal pattern.

The cover supports can be configured to increase the rigidity of the cover member.

The additional supports can be additional liner supports in form of protrusions extending from the additional liner exterior surface.

The liner supports can have a longitudinal structure.

The additional liner supports can be configured to engage the cover supports and to rest thereon when the additional liner member is received within the cover member.

The additional liner supports can be configured to engage the cover interior surface and to rest thereon when the additional liner member is received within the cover member.

The cover supports can be configured to engage the additional liner exterior surface and to rest thereon when the additional liner member is received within the cover member.

Each of the additional chambers can be defined by the additional chamber wall, a corresponding portion of the cover interior surface and at least one of the following: the corresponding additional liner supports and the corresponding cover supports.

The additional liner member can include a plurality of receptacles, each configured to receive a tool and to hold it securely.

The receptacles can have an open bottom.

When the additional liner is configured with an additional liner rim, and the cover member is configured with a cover rim, the additional liner rim can securely rest on the cover rim. The additional liner rim can correspond in shape and size to the cover rim when the additional liner member is received within the cover member, so that in the closed position of the toolbox, the additional liner rim is clamped between the base rim and the cover rim, thereby sealing the toolbox.

When the liner member is configured with the liner rim and the additional liner member is configured with the additional liner rim, in the closed position of the toolbox, the liner rim and the additional liner rim are clamped between the base rim and the cover rim, thereby sealing the toolbox.

The additional liner member can be securely received within the cover member.

The secure attachments of the additional liner member to the cover member can be provided by a plurality of fasteners connecting therebetween.

When the additional liner member is received within the cover member and its additional liner rim rests on the cover rim, its rigid though pliable material allows the additional liner rim to constitute a sealing member serving as a gasket for providing the sealing to the toolbox in its closed position.

The material of the base member and the cover member can be plastic.

The toolbox can further comprise at least one latch configured for fastening the base member and the cover member to each other in the closed position of the toolbox.

According to another aspect of the presently disclosed subject matter, there is provided a toolbox comprising:

a base member;

a cover member pivotally articulated to the base member. The toolbox has an open in which the base member is pivotally disengaged from the cover member and a closed position in which the base member is engaged with the cover member; and a restricting mechanism configured to restrict the angle between the cover member and the base member in the open position of the toolbox and to support the cover with respect the base member in this position of the toolbox.

The restricting mechanism is configured with a stopping element having a pivoting portion pivotally mounted to a hinge portion of the cover member and at least one sliding end disposed within at least one corresponding recess formed within the base member. The sliding end is configured to slide within the recess between the open and the closed positions of the toolbox.

The recess can have a longitudinal shape.

The recess can have a recess engagement portion on which the respective sliding end rests in the open position of the toolbox.

BRIEF DESCRIPTION OF THE DRAWINGS

In order to understand the invention and to see how it can be carried out in practice, the embodiments will now be described, by way of non-limiting examples only, with reference to the accompanying drawings, in which.

DETAILED DESCRIPTION OF EMBODIMENTS

Figure 1A:
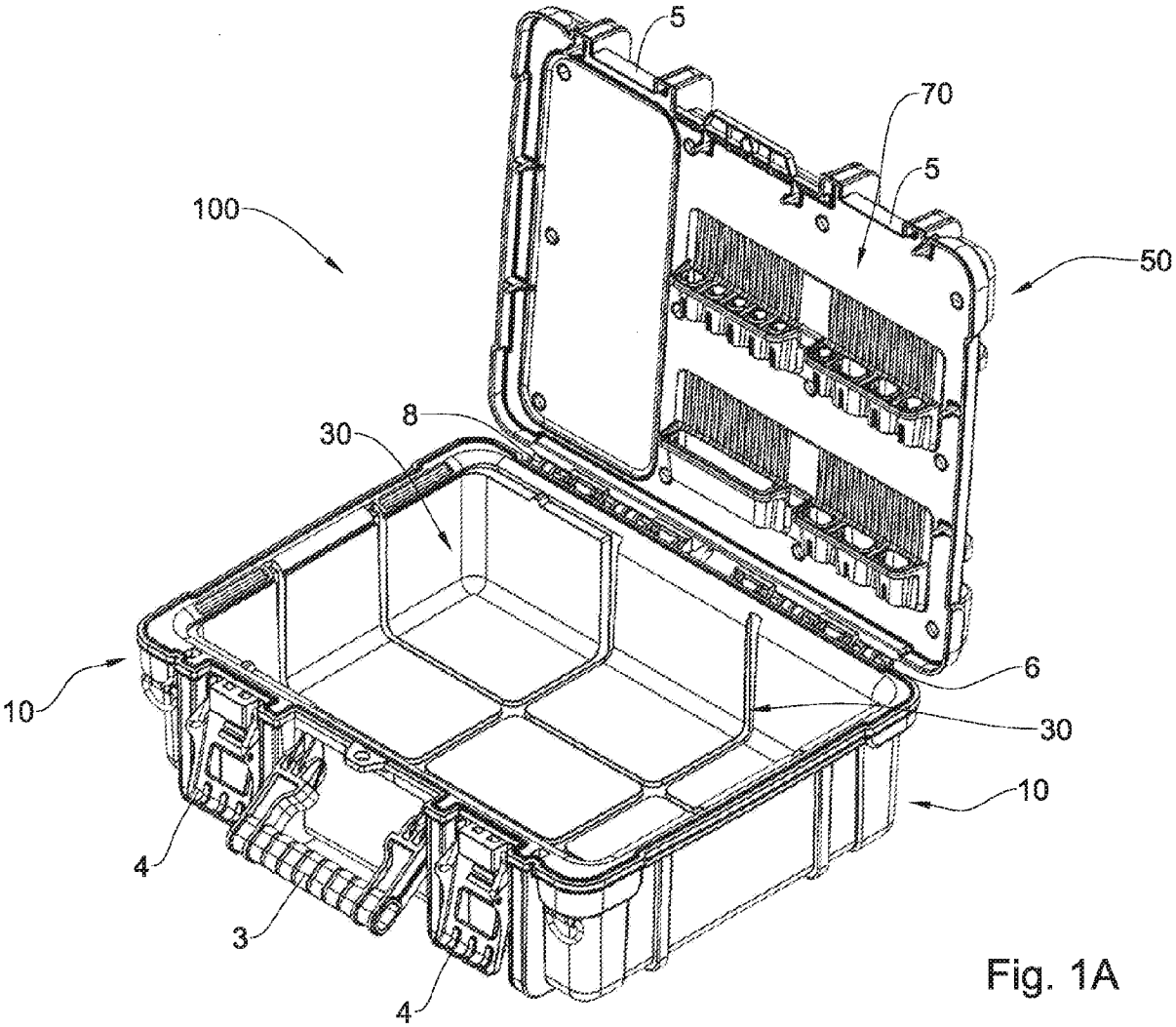
FIG. 1A is a front perspective view of a toolbox in its open position, in accordance with one example of the presently disclosed subject matter.

Attention is first directed to FIG. 1A of the drawings illustrating a toolbox in accordance with one example of the presently disclosed subject matter, generally designated 100. The toolbox 100 comprises a base member 10 with a first liner member 30 received therein, and a cover member 50 with a second liner member 70 received therein.

The first liner member 30 is received within and supported by the base member 10 in a spaced apart relationship therebetween so as to allow the first liner member 30 to be deformed towards the base member 10, as explained below. The second liner member 70 is received within and supported by the cover member 50 in a spaced apart relationship therebetween so as to allow the second liner member 70 to be deformed towards the cover member 50, as explained below.

The base member 10 and the cover member 50 are pivotally articulated to each other by means of hinges 6 and 8. The toolbox 100 is configured to be in an open position (shown in FIGS. 1A and 1B) and a closed position (shown in FIG. 4A).

The toolbox 100 further includes two latches 4, each of which is configured to be securely engaged with corresponding engagement portions 5 of the cover member 50, for fastening the base member 10 to the cover member 50 in the closed position of the toolbox 100. In addition, the toolbox 100 includes a handle 3 which can be used for holding the toolbox 100 and transporting it from place to place.

Figure 1B:
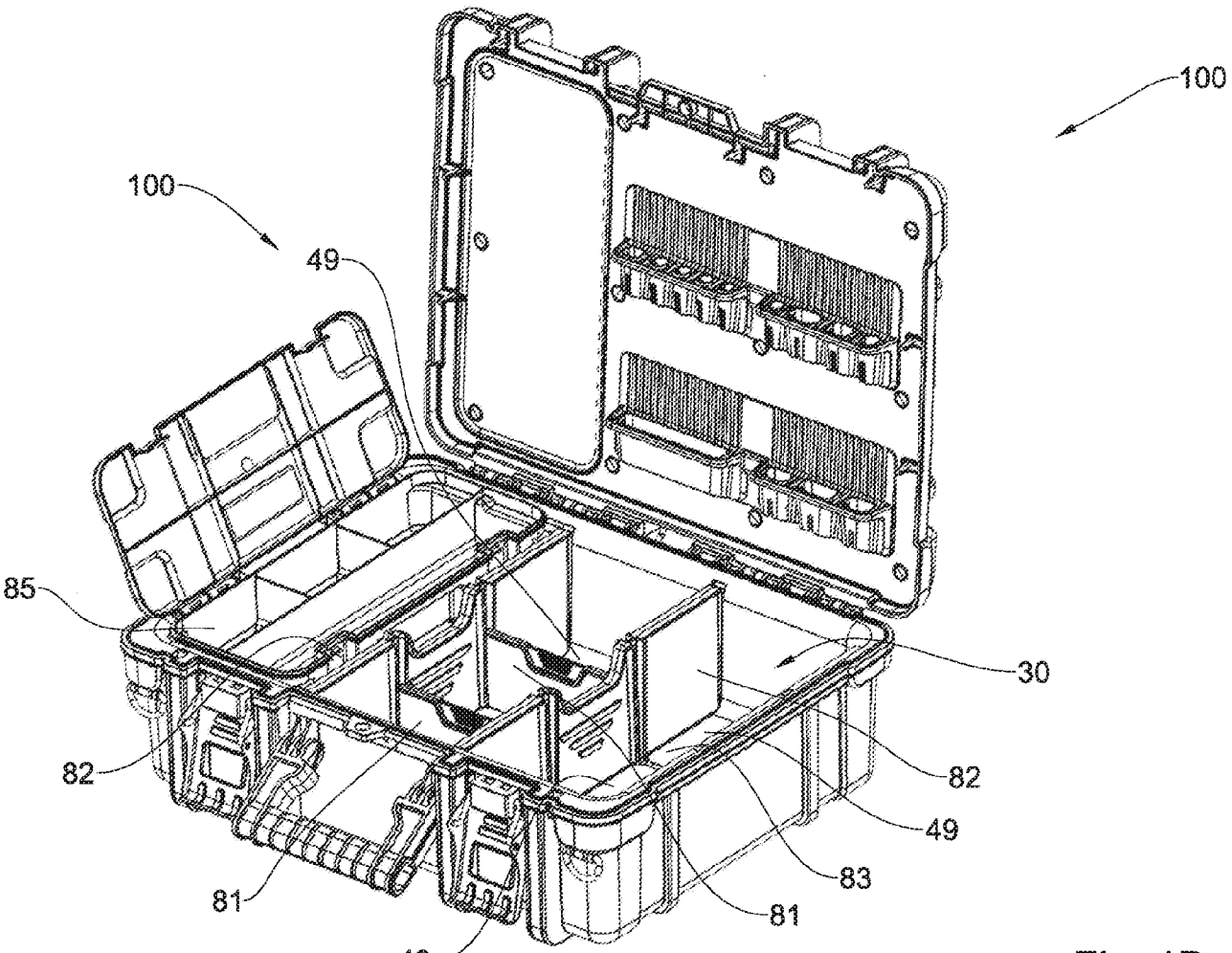
FIG. 1B is the toolbox of FIG. 1A with a plurality of dividers.

Reference is now made to FIG. 1B, in which it is shown that the first liner member 30 includes a two lengthwise dividers 81 and two widthwise dividers 82. The dividers 81 and 82 divide the first liner member 30 into a plurality of compartments 83. Each of the compartments 83 is configured with at least one chamber wall 49 disposed at its bottom, the structure of which is described below. The compartments 83 are configured to accommodate a plurality of tools therein. As shown in FIG. 1B, a compartment has a box 85 received therein. The box 85 is supported by one the widthwise dividers 82 and the liner interior surface 37. The box 85 can be used for accommodating small tools.

The base member 10 and the cover member 50 are made of a substantially rigid material. The first liner member 30 and the second liner member 70 are made of a rigid though pliable material. The type of the material from which the first liner member 30 and the second liner member 70 are made, and their spaced apart relationship with respect the base member 10 and the cover member 50, allow them to be deformed, and particularly to be bent towards the base member 10 and the cover member 50, respectively.

The rigidity of the base member 10 and the cover member 50 can be such that upon application of reasonable forces, they will substantially preserve their original shape and structure.

Reference is now made to FIGS. 2A to 2H, which schematically illustrate the base member 10 and the first liner member 30, in a detailed manner The base member 10 has a base front wall 11, a base rear wall 12 , base right and left side walls 13 and 14, respectively, which extend from a base bottom 15 to a perimetric base rim 16, and defining together a base interior storage space 18. The base front wall 11, the base rear wall 12, the base right and left side walls 13 and 14 and the base bottom 15 are configured with a base interior surface 17 and a base exterior surface 19.

The first liner member 30 has a first liner front wall 31, a first liner rear wall 32, first liner right and left side walls 33 and 34, respectively, extending from a first liner bottom 35 to a perimetric first liner rim 36, and defining together a first liner interior storage space 38. The first liner front wall 31, the first liner rear wall 32, the first liner right and left side walls 33 and 34 and the first liner bottom 35 are configured with a first liner interior surface 37 a first liner exterior surface 39.

The first liner member 30 is designed and configured to be securely received and received on the base member 10 in accordance with the illustration of broken lines 9. For this mounting, the first liner rim 36 and the first liner exterior surface 39 are designed to correspond in shape and size to the base rim 16 and the base interior surface 17, respectively.

Figure 2A:
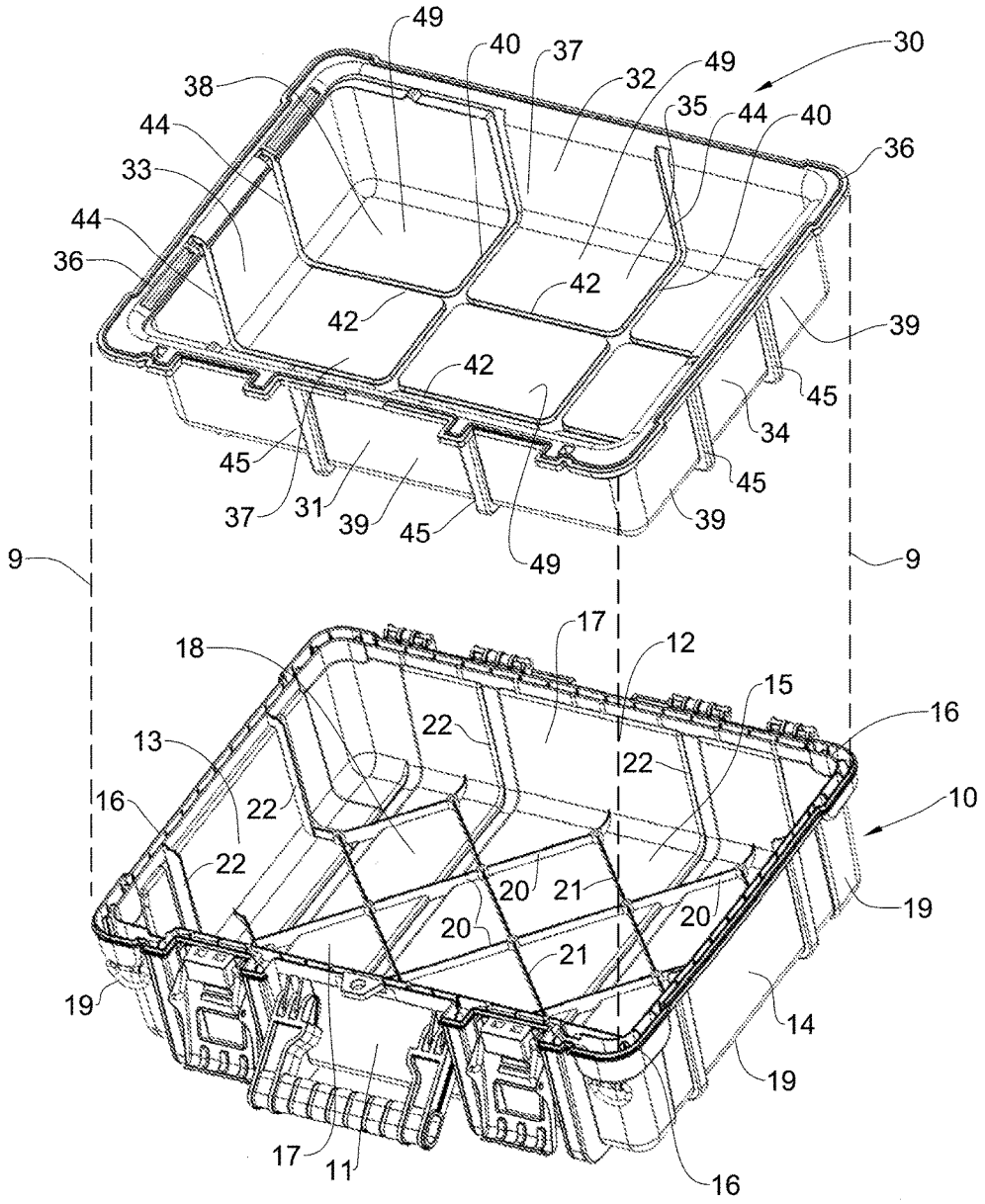
FIG. 2A is a perspective view of a base member and a first liner member of the toolbox of FIG. 1A, being disengaged from each other.
Figure 2B:
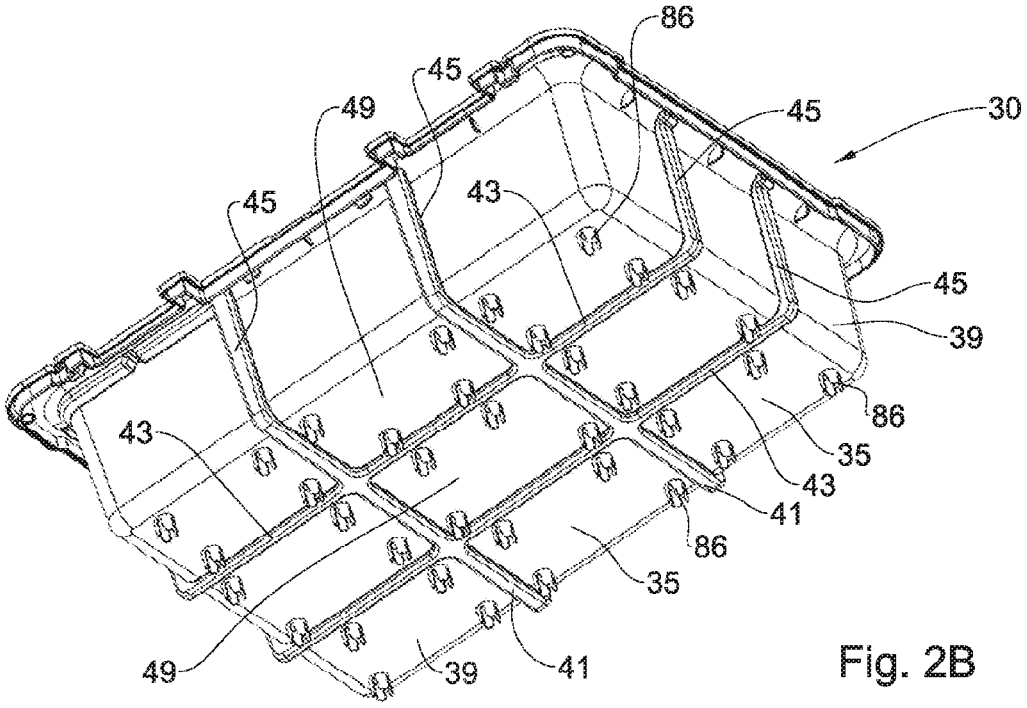
FIG. 2B is a perspective bottom view of the first liner member of FIG. 2A.
Figure 2C:
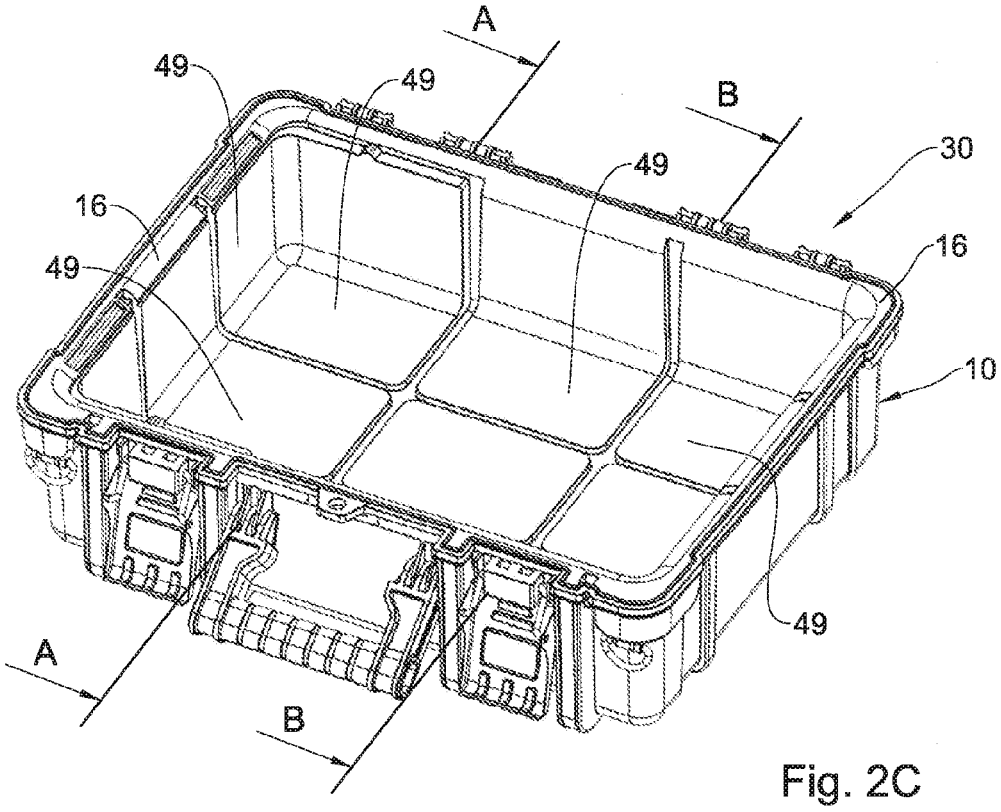
FIG. 2C is a perspective view of a base member and a first liner of the toolbox of FIG. 2A, being engaged with each other.
Figure 2D:
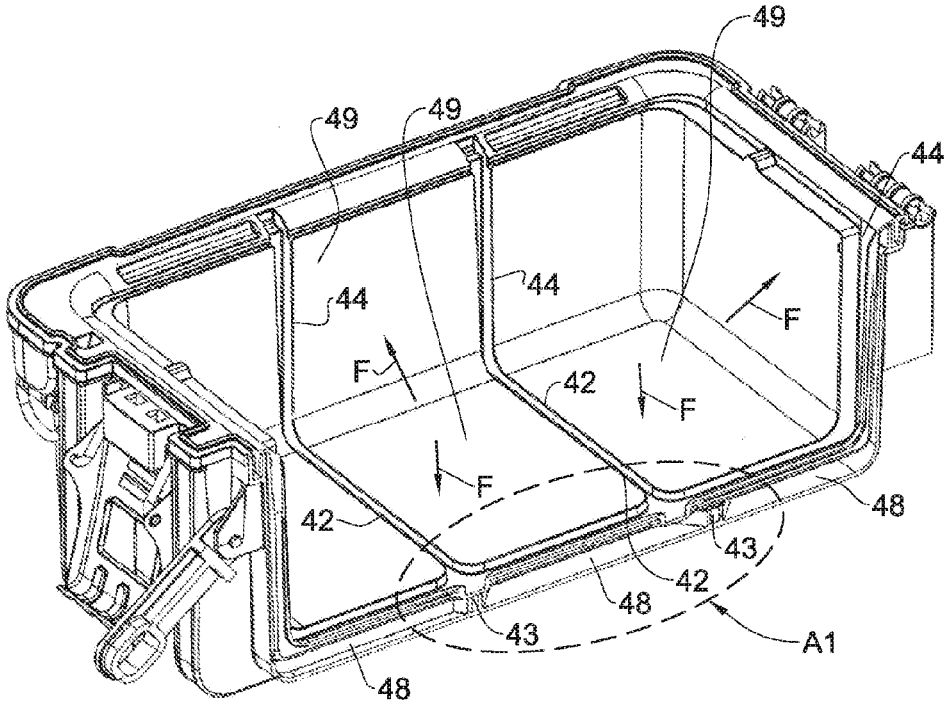
FIG. 2D is a cross-sectional view along line A-A in FIG. 2C.
Figure 2E:
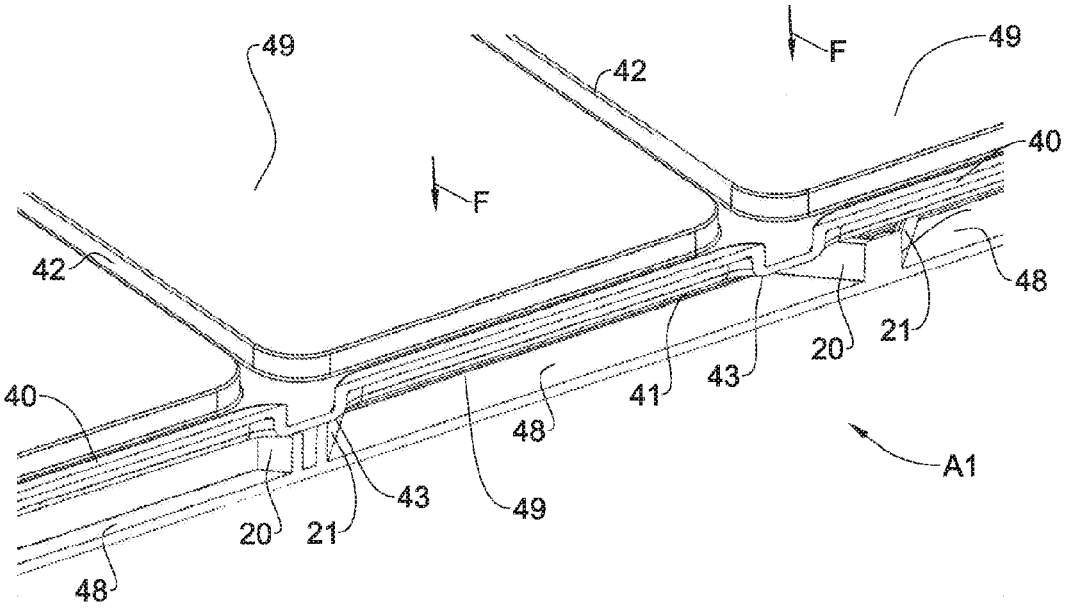
FIG. 2E is an enlarged view of section A1 of FIG. 2D.

As shown in FIG. 2C, the first liner member 30 is received on the base member 10. In this configuration, the first liner rim 36 rests on and entirely covers the base rim 16 while the first liner exterior surface 39 is brought into proximity and engages the base interior surface 17. The first liner member 30 can be easily disengaged from the base member 10 by a user for different reasons and task, such as maintenance procedures. The engagement of the first liner rim 36 and the base rim 16 is detailed below with reference to FIGS. 4A to 4F.

The base interior surface 17 comprises longitudinal base supports extending therefrom for providing the spaced apart relationship between the base member 10 and the first liner member 30. The base supports include:

- a first group of base supports 20 extending from the base bottom 15, arranged according to a diagonal pattern and parallel to each other;
- a second group of base supports 21 extending from the base bottom 15, arranged according to a diagonal pattern, parallel to each other, and perpendicular to the base supports 20; and
- a third group of base supports 22 extending from the base interior surface 17, and particularly from the side walls 11, 12, 13 and 14 of the base member 10, and are parallel to each other.

The first liner member 30 has longitudinal liner recesses formed within the first liner interior surface 37, and corresponding longitudinal liner supports extending from the first liner exterior surface 39. The liner recesses and the liner supports are divided to three groups:

- a first group of widthwise liner recesses 40 and their corresponding liner supports 41 (shown in FIGS. 2B and 2E) formed in the first liner bottom 35, and parallel to each other; and
- a second group of lengthwise liner recesses 42 and their corresponding liner supports 43 formed in the in the first liner bottom 35. The supports 43 are perpendicular to the supports 41.
- a third group of liner recesses 44 and their corresponding liner supports 45 extending from the sidewalls 31, 32, 33 and 34 of the liner member 30.

The liner recesses 40, 42 and 44 are configured to receive the dividers 81 and 82.

The base supports 20, 21 and 22 are configured to provide support to the first liner exterior surface 39, when engaging the base interior surface 17. In particular, when the liner member 30 is received on the base member 10, the liner supports 41 and 43 engage and rest on the base supports 20 and 21, the liner supports 45 engage the base interior surface 17, and the base support 22 engage the liner exterior surface 39, thereby providing support to the liner member 30.

As shown in FIGS. 2B to 2G, when the first liner 10 is received within the base member 30 in a spaced apart relationship between the liner exterior surface 39 and the base interior surface 17, the first liner exterior surface 39 engages the base interior surface 17 with a plurality of chambers 48 formed therebetween. Each of the chambers 48 has a chamber wall 49, constituted by a corresponding portion of the liner member 30. Each of chamber walls 49 is configured to be deformed (e.g., bent) towards the base interior surface 17, thereby compressing the volume of its respective chamber 49. The chamber walls 49 are distanced from the base interior surface 17 so that they have enough space to be deformed towards the base interior surface 17 upon application of a pressing force thereon from the liner interior storage space 38 by at least one tool accommodated therein. This pressing force is indicated in FIGS. 2C to 2G, for example, by arrows F. The above described structure of the chambers 48 and the pliability of the material from which the chamber walls 49 are made, allow the chambers walls 49 to be deformed towards the base exterior surface 19, as described above. This characteristic of the chamber walls 49, and generally of the liner member 30, can be used for absorbing and/or reducing shock and noise generated by tools that are accommodated within the toolbox 100, during their transportation.

Figure 2F:
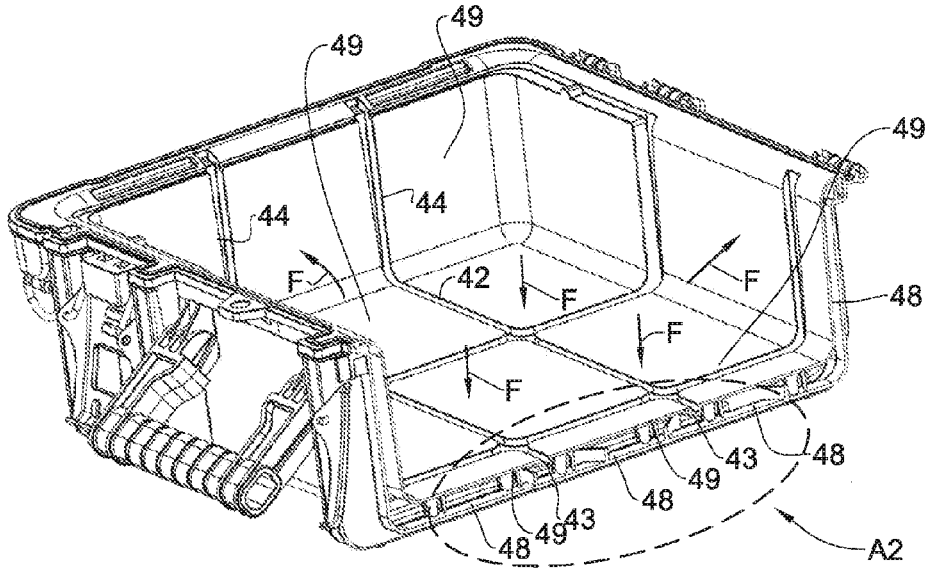
FIG. 2F is a cross-sectional view along line B-B in FIG. 2C.
Figure 2G:
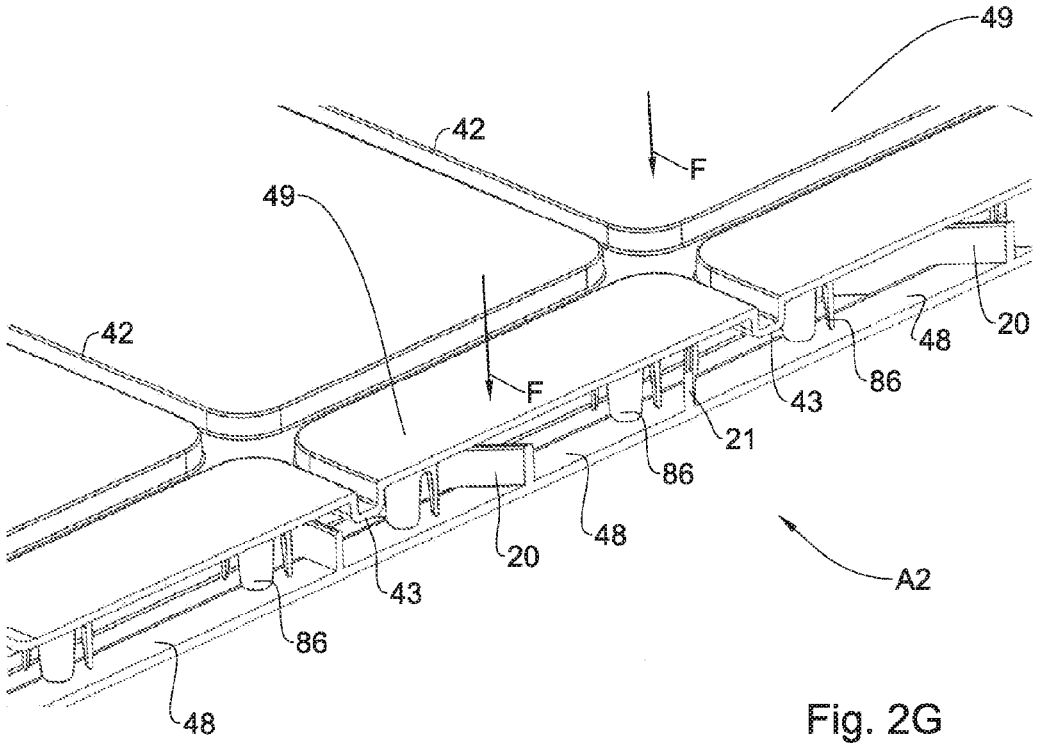
FIG. 2G is an enlarged view of section A2 of FIG. 2F.
Figure 2H:
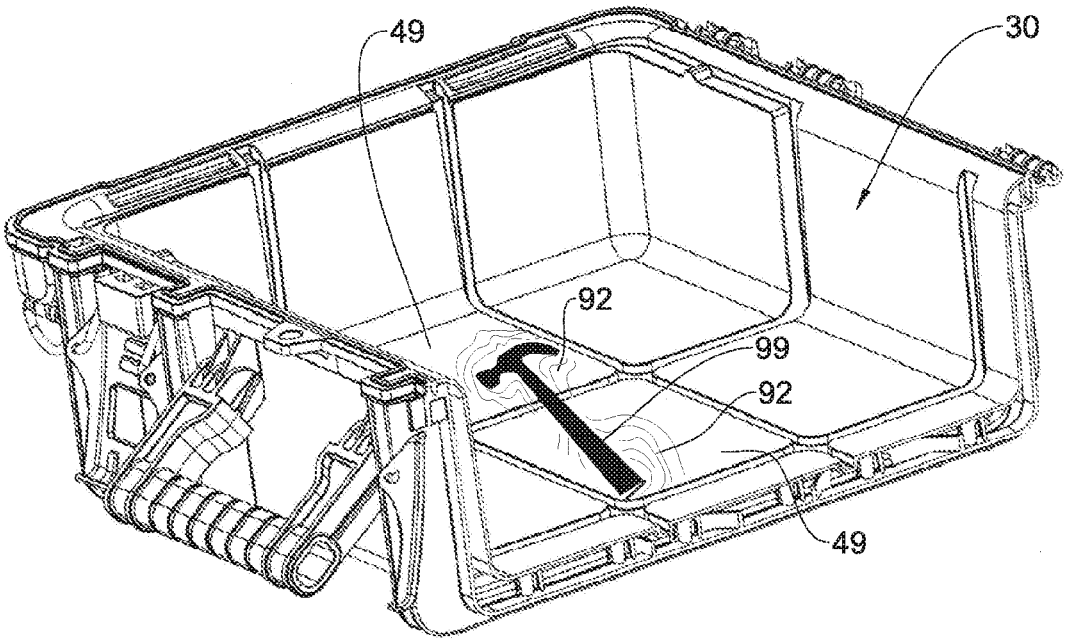
FIG. 2H is the toolbox of FIG. 2F with a tool accommodated therein.

An Example of a tool 99 disposed within the toolbox 100 and positioned on the liner member 30, is shown in FIG. 2H. In this figure is can be seen how the tool 99 applies pressing forces on the chamber walls 49 of the liner member 30, and deformed their original shape and structure. This deformation is represented in FIG. 2H by deformation lines 92.

In summary, depending on the location of a particular chamber 48, its walls can be defined by one of the following elements: a chamber wall 49, a corresponding portion of the base interior surface and at least one of the following: the corresponding liner supports and the corresponding base supports.

As shown in FIGS. 2B, 2F and 2G, the liner member 30 further includes a plurality of flexible legs 86 extending out of the liner exterior surface 39. The legs 86 are structured of bendable wings one end of which is connected to the liner exterior surface 39 and the second end of which is configured to engage the base interior surface 19. The legs 86 are configured to lean on the base interior surface 19, upon application of the pressing force F, and thereby to provide a resilient support when the force F is applied.

The base member 10 and the cover member 50 are made of a rigid material, and particularly plastic. The first liner member 30 is made of a rigid though pliable material, and particularly a combination of 50% Linear low-density (LLD) Polyethylene and 50% low-density (LD) Polyethylene. The first liner member 30 can be manufactured as a single-molded element.

In addition, the first liner member 30 is water impermeable, stable for long lasting usage, it doesn't absorb dirt easily, and is chemically resistant to various substances. The first liner member 30 is designed to resist specific chemical environments and materials which are usually stored within toolboxes.

Figure 3A:
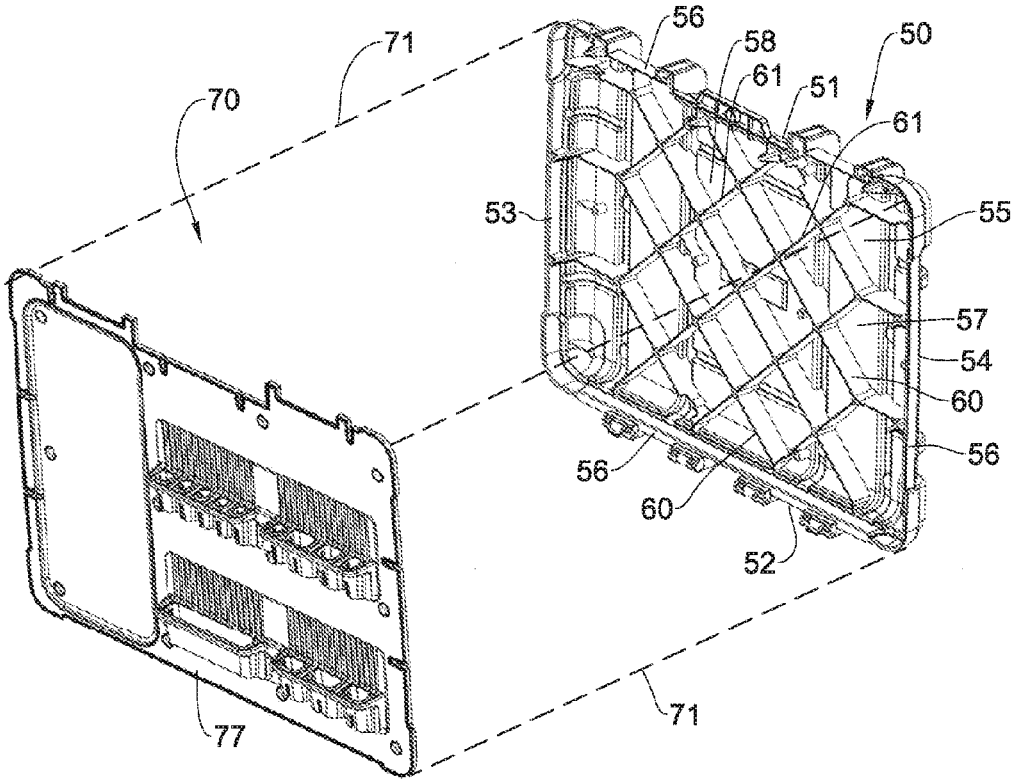
FIG. 3A is a perspective view of a cover member and a second liner of the toolbox of FIG. 1A, being disengaged from each other.
Figure 3B:
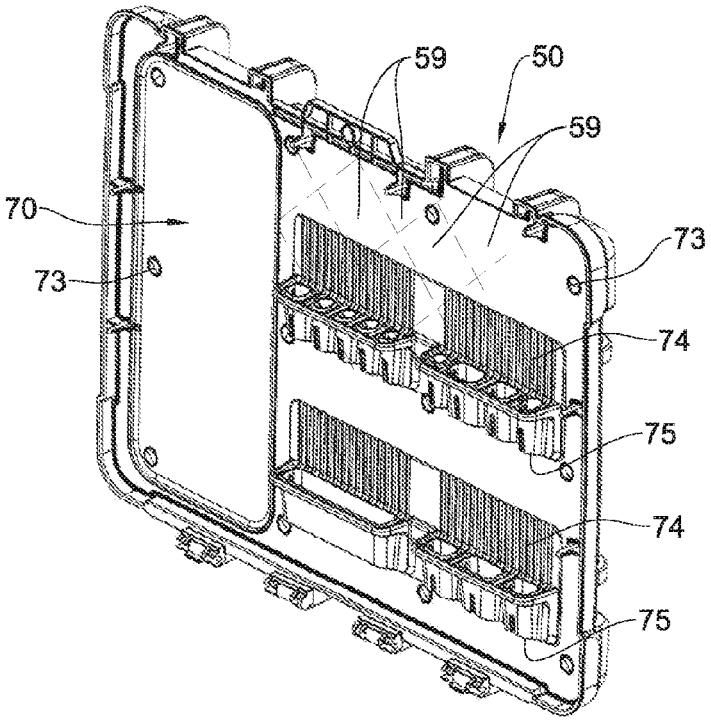
FIG. 3B is a perspective view of a cover member and a second liner of the toolbox of FIG. 3A, being engaged with each other.

Reference is now made to FIGS. 3A to 3B, which schematically illustrate the cover member 50 and the second liner member 70, in a detailed manner. The cover member 50 has a cover front wall 51, a cover rear wall 52, cover right and left side walls 53 and 54, respectively, which extend from a cover bottom 55 to a perimetric cover rim 56, and defining together a cover interior storage space 58. The cover front wall 51, the cover rear wall 52, the cover right and left side walls 53 and 54 and the cover bottom 55 are configured with a cover interior surface 57 and a cover exterior surface 59 (shown in FIG. 4A). The cover rim 56 corresponding in shape and size to fit the base rim 16.

In the open position of the toolbox 100, the base rim 16 is disengaged from the cover rim 56, and in the closed position, the base rim 16 is engaged with the cover rim 56.

The second liner member 70 has a second liner interior surface 77 and a second liner exterior surface (not shown).

The second liner member 70 is designed to be mounted to the cover member 50 in accordance with the illustration of broken lines 71. For this mounting, the second liner exterior surface is designed to correspond in shape and size to the cover interior surface 57.

As shown in FIG. 3B, the second liner member 70 is mounted to the cover member 50 in a spaced apart relationship between the second liner exterior surface 79 and the cover interior surface 57 so as to allow the second liner member 70 to be deformed towards the cover interior surface 57. The second liner member 70 is connected to the cover member 50 by fasteners 73. The second liner member 70 can be easily disengaged from the cover member 50 by a user for different reasons and task, such as maintenance procedures.

The cover interior surface 57 comprises longitudinal cover supports extending therefrom, configured for providing the spaced apart relationship between the cover member 50 and the second liner member 70. The cover supports include:

- a first group of cover supports 60 extending from the base bottom 55, arranged according to a diagonal pattern and parallel to each other;
- a second group of cover supports 61 extending from the cover bottom 55, arranged according to a diagonal pattern, parallel to each other, and perpendicular to the cover supports 60; and The second liner member 70 is made of a rigid though pliable material, and particularly a combination of 50% Linear low-density (LLD) Polyethylene and 50% low-density (LD) Polyethylene. The second liner member 70 can be manufactured as a single-molded element.

In addition, the second liner member 70 is water impermeable, stable for long lasting usage, it doesn't absorb dirt easily, and is chemically resistant to various substances. The second liner member 70 is designed to resist specific chemical environments and materials which are usually stored within toolboxes.

The second liner member 70 further includes a plurality of resilient receptacles 74 with an open bottom 75, each configured to receive a tool (not shown) and to hold it securely therein.

The second liner member 70 is configured to be received to the cover member 50 so that the second liner exterior surface partially engages the cover interior surface 57 with a plurality of additional chambers (not shown) formed therebetween. Each of the additional chambers is defined by an additional chamber wall 59 constituted by a corresponding portion of the additional liner member 70, corresponding portions of the cover supports 60 and 61 and a corresponding portion the cover interior surface 57. The additional chamber walls 59, examples of which are schematically illustrated in FIG. 3B, are configured to be deformed towards the cover interior surface 57, thereby compressing the volume of their respective additional chamber. The additional chamber wall can be bent upon application of a pressing force thereon from the additional liner interior storage space of the toolbox by at least one tool accommodated therein.

When the second liner member 70 is received within the cover member 50, its material and the above described additional chambers allow it to constitute a pliable supporting surface for absorbing and/or reducing shock and noise generated by the tools that are accommodated within the toolbox during transportation of the toolbox in its closed position.

Reference is now made to FIGS. 4A to 4F, which schematically illustrate the toolbox 100 in its closed position. In this closed position of the toolbox 100, the base member 10 and the cover member 50 are securely fastened to each.

Figure 4A:
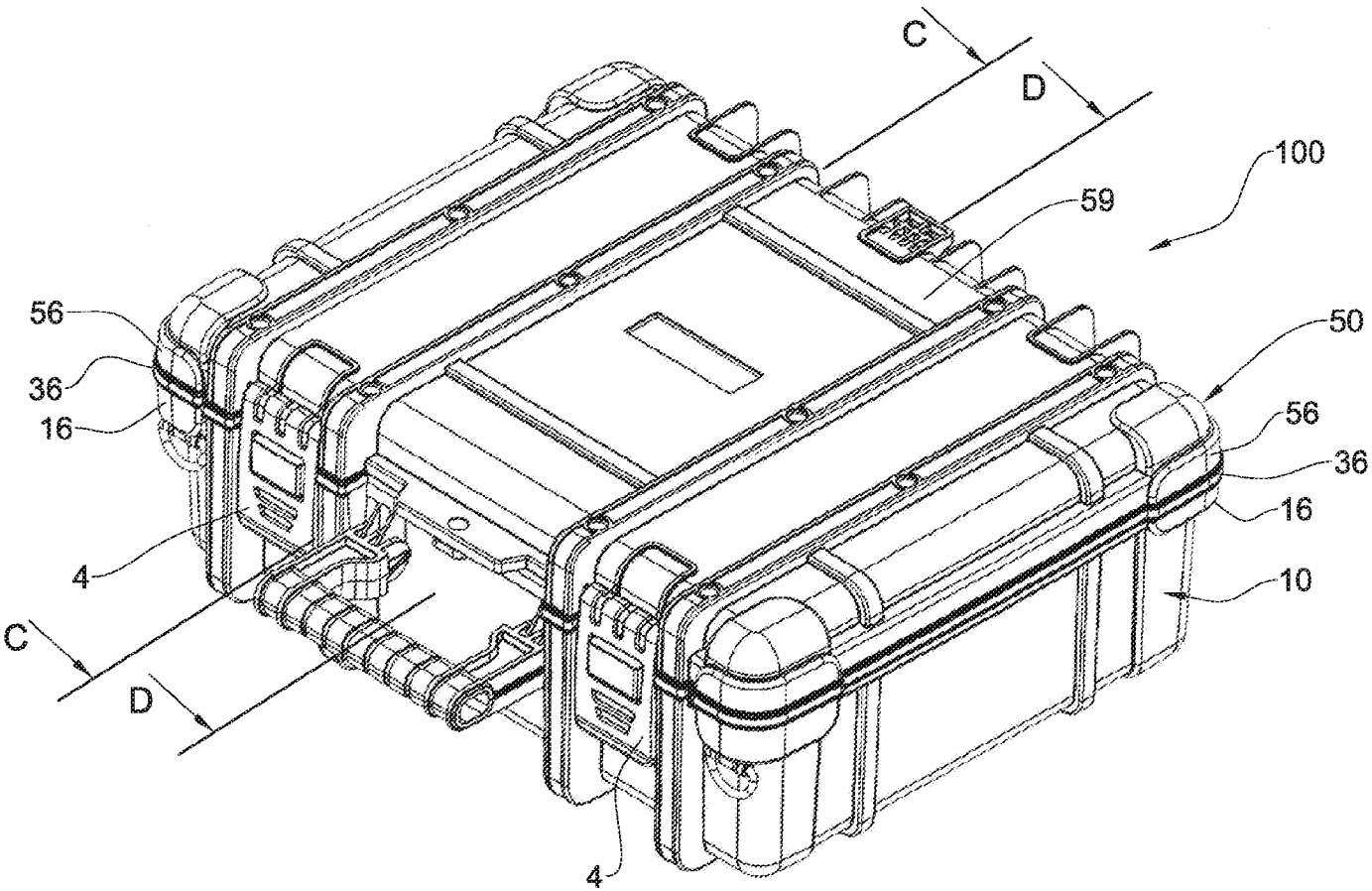
FIG. 4A is a front perspective view of the toolbox of FIG. 1A in its closed position.
Figure 4B:
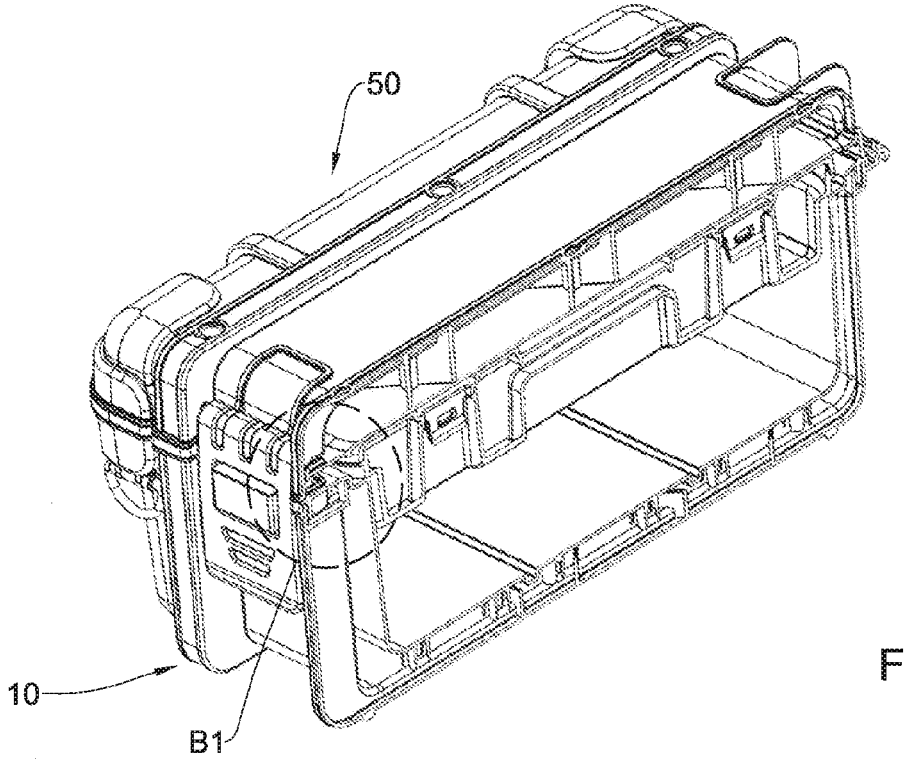
FIG. 4B is a cross-sectional view taken along line C-C in FIG. 4A.
Figure 4C:
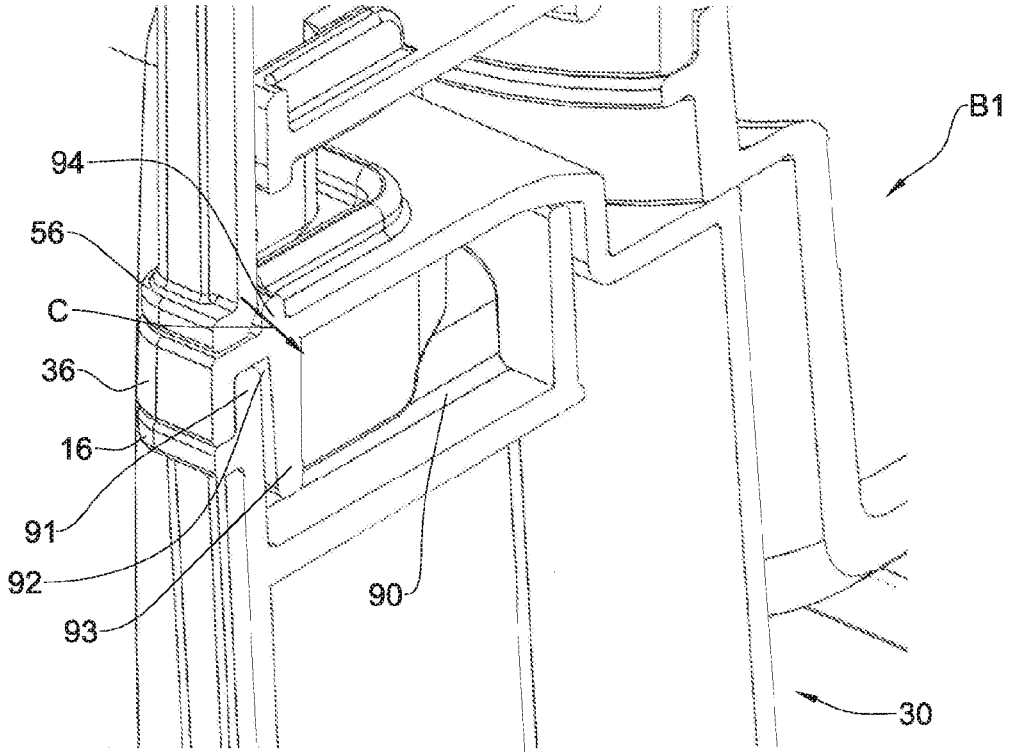
FIG. 4C is an enlarged view of section B1 of FIG. 4B.
Figure 4D:
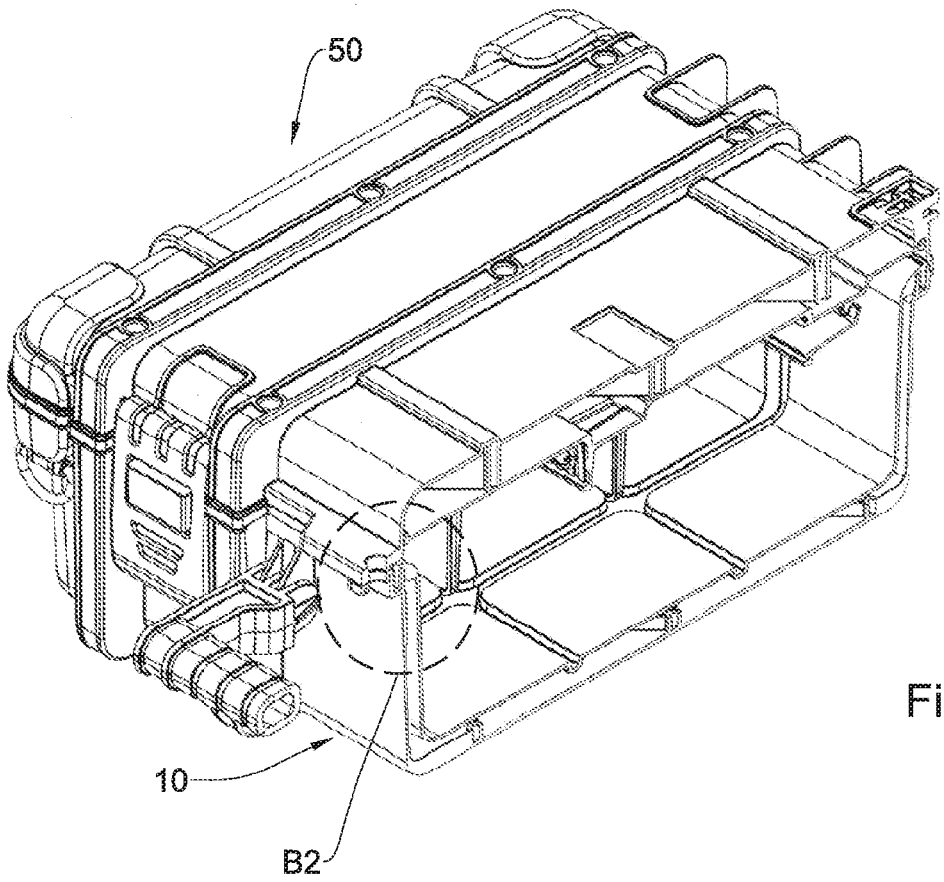
FIG. 4D is a cross-sectional view taken along line D-D in FIG. 4A.
Figure 4E:
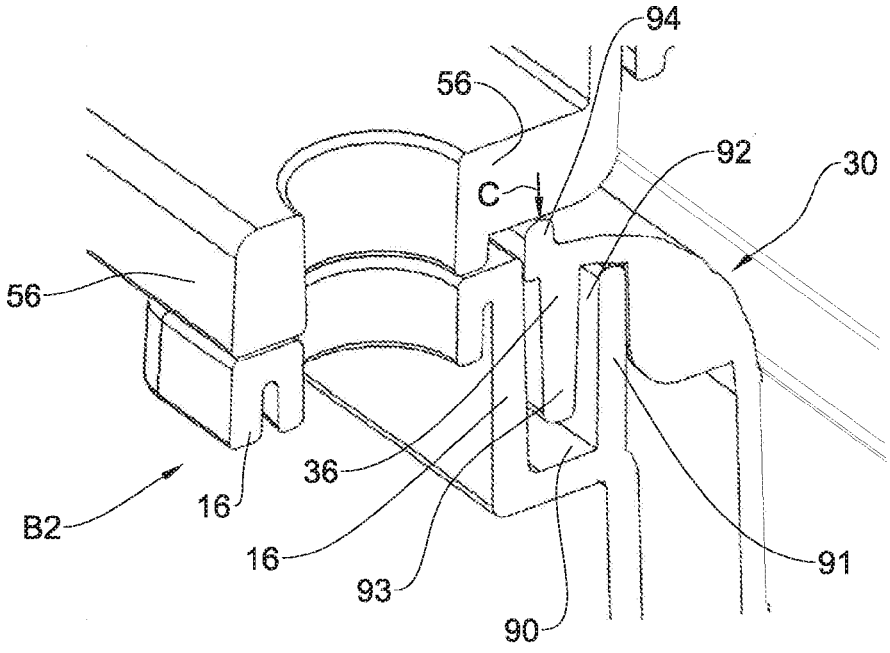
FIG. 4E is an enlarged view of section B2 of FIG. 4D.

As clearly shown in FIG. 4A, the cover rim 56, the base rim 16 and the first liner rim 36 are corresponding in shape and size with each other, and particularly have the same contour, so as to provide a sealed closure of the toolbox 100 in its closed position. This sealing is provided by the first liner rim 36 which is securely clamped between the base rim 16 and the cover rim 56, thereby constituting a sealing member serving as a gasket.

In the closed position of the toolbox 100, the latches 4 are securely engaged with the corresponding portions 5 of the cover member 50, thereby securely fastening the base member 10 to the cover member 50. The first liner rim 36, which is used a sealing member, provides sealing to the interior of the toolbox 100, and particularly water-resistance. This function of the first liner rim 36 is additional to the above describes function of the rest of body of the first liner member 30 which can be used as a tool tray for accommodating various tools therein. This ability of the toolbox 100 which is provided by the first liner member 30 allows it to be sealed and at the same time to be able to absorb shock and noise of the tools accommodated therein, when transported from place to place.

Reference is now made specifically to FIGS. 4B to 4F, in which it is clearly shown how the first liner rim 36 is disposed between the base rim 16 and the cover rim 56, thereby sealing the toolbox 100. In particular, it is shown in these figures that the base rim 16 has a base rim recess 90 and a base rim protrusion 91. The liner rim 36 has a liner rim recess 92 and a liner rim lower protrusion 93. The liner rim lower protrusion 93 is received within the base rim recess 90, and the base rim protrusion 91 is received within the liner rim recess 92, for securely mounting the liner rim 30 on the base member 10, and providing the sealing of the toolbox 100. The liner rim 30 further has a liner rim upper protrusion 94. In the closed position of the toolbox 100, the cover rim 56 is configured to engage the liner rim upper protrusion 94 and to apply a clamping force thereon. This force is indicated, for example, in FIGS. 4C and 4E by an arrow C. This force causes the liner rim lower protrusion 93 to be pushed into the base rim recess 90, thereby improving the clamping of the liner rim 36 between the cover rim 56 and the base rim 16, and accordingly improving the sealing of the toolbox 100.

Figure 5A:
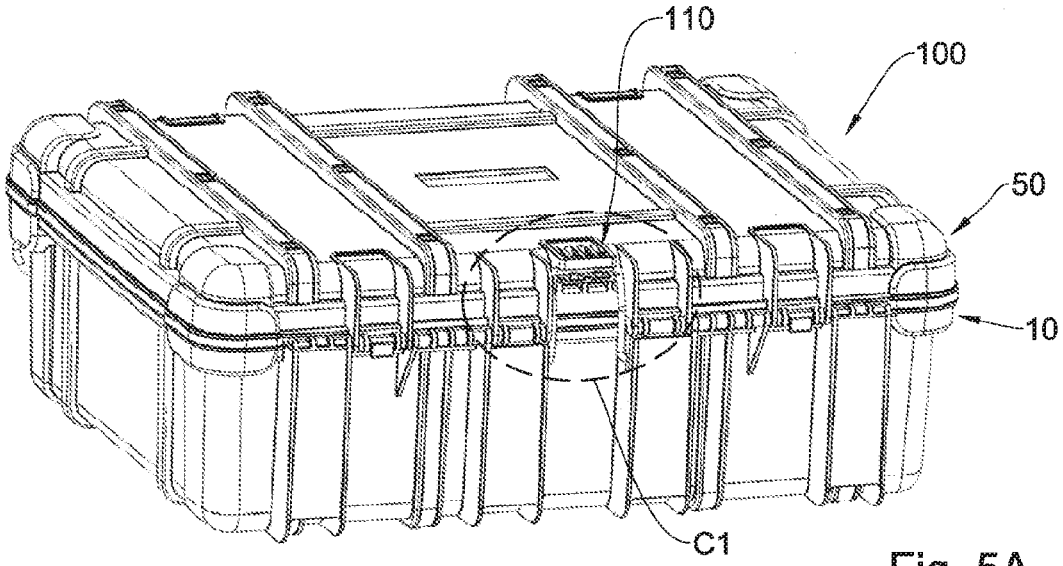
FIG. 5A is a rear perspective view of a toolbox of FIG. 4A.
Figure 5B:
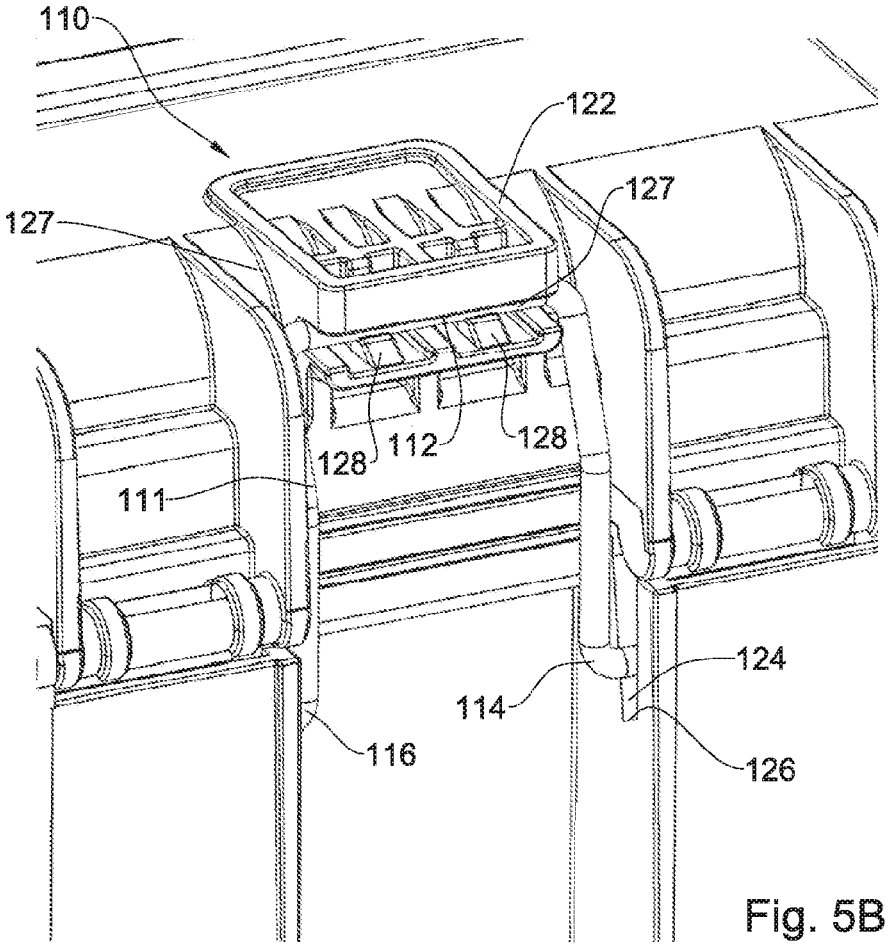
FIG. 5B is an enlarged view of section C1 of FIG. 5A.
Figure 5C:
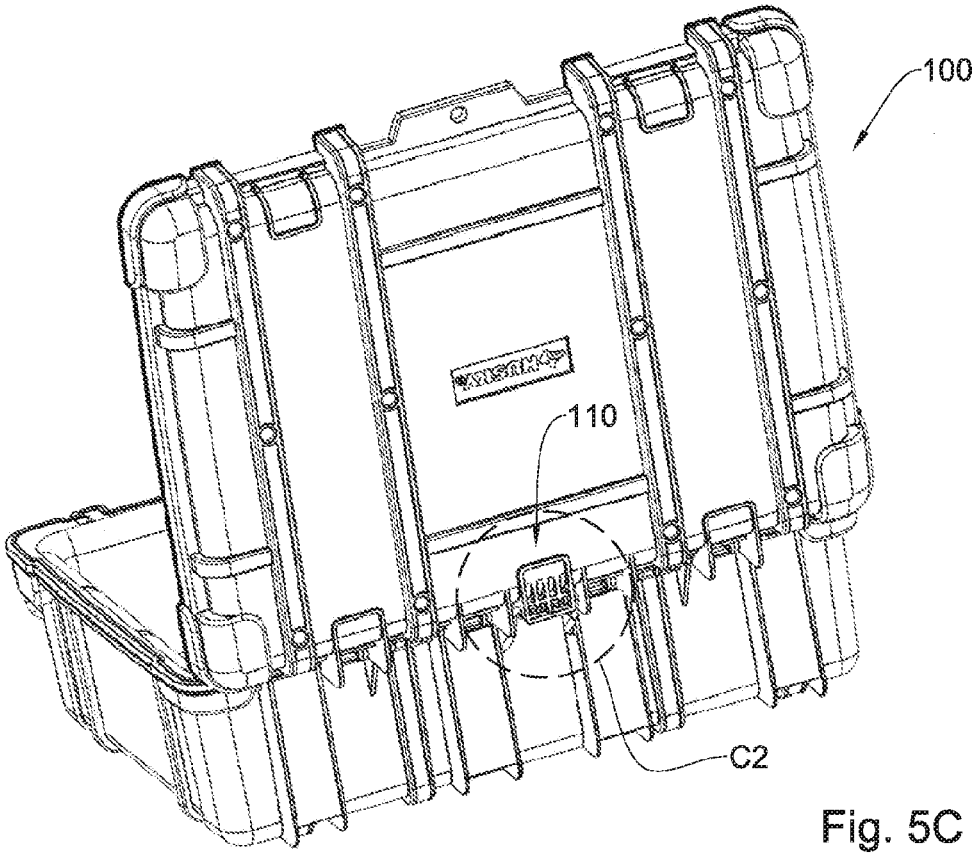
FIG. 5C is a rear perspective view of a toolbox of FIG. 1A.

Reference is now made to FIGS. 5A to 5D, in which a restricting mechanism 110 of the toolbox 100 is illustrated. The restricting mechanism 110 is configured to support the cover with respect the base member in the open position of the toolbox 100 and to restrict the angle between the cover member 10 and the base member 50 in this position. As shown in FIG. 5C, the cover member 50 is disposed at its maximal angle with respect to the base member 10 and cannot be diverted to a larger angle due to the stopping member 110.

The restricting mechanism 110 is disposed at the back of the toolbox 100, between the hinges 6 and 8.

The restricting mechanism 110 has a stopping element 111 with a pivoting portion 112 and two sliding ends 114 and 116. The pivoting portion 112 is pivotally received within a hinge portion 122 of the cover member 10 and the two sliding ends 114 and 116 are disposed within two corresponding longitudinal recesses designated as 124 (only one is seen in FIG. 5B), formed within the base member 10. The longitudinal recesses allow the sliding ends 114 and 116 to linearly slide therein during the angular movement of the cover member 50 with respect to the base member 10 when the toolbox is converted between its open position and its closed position.

The hinge portion 122 has an opening 127 through which the pivoting portion 112 can be inserted, and holding protrusions 128, each of which is configured to hold the pivoting portion 112 within the hinge portion 122. It should be indicated that the pivoting portion 112 can be extracted from the hinge portion 122. This can be performed in order to cancel the operation of the restricting mechanism 110, and thereby cancelling the restriction of the angle between the cover member 50 and the base member 10 in the open position of the toolbox 100.

Figure 5D:
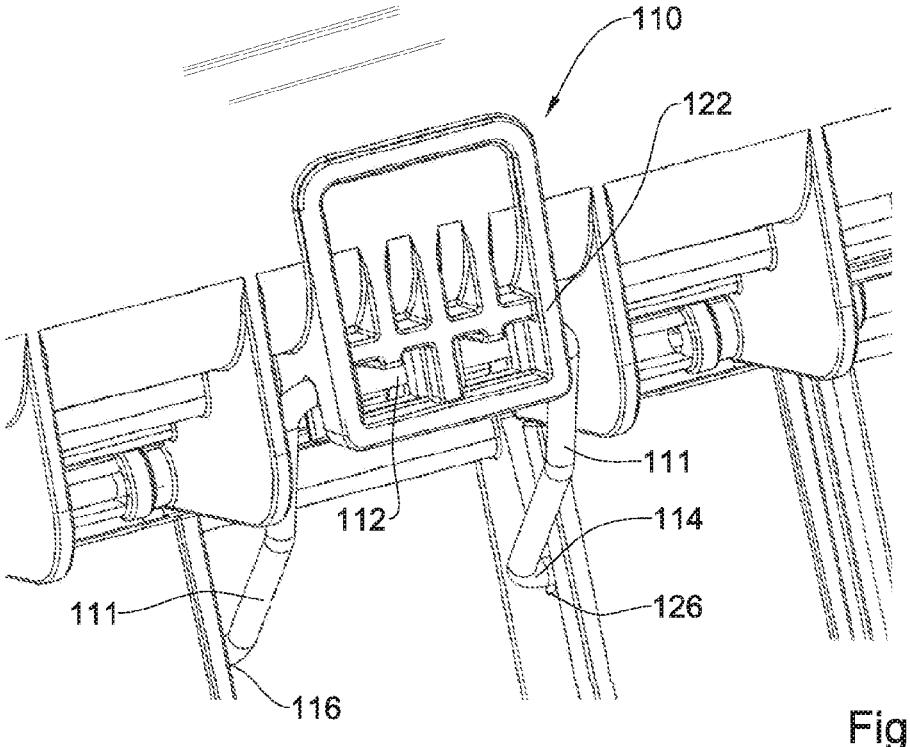
FIG. 5D is an enlarged view of section C2 of FIG. 5C.

In addition, it should be noticed that the pivoting portion 112 cannot be extracted from the hinge portion 122 in the open position of the toolbox 100 since it is trapped therein, as shown in FIG. 5D.

Each of longitudinal recesses 124 has a recess engagement portion 126 (one of which is seen in FIGS. 5B and 5D) on which the respective sliding end rests in the open position of the toolbox. As shown in FIG. 5B, the sliding end 114 rests on a recess engagement portion 126 in the open position of the toolbox 100. The location of the recess engagement portions 126 in the longitudinal recesses 124 defines the maximal angle to which the cover member 50 can be diverted with respect to the base member 10.

According to different examples, the location of the recess engagement portions 126 within the longitudinal recesses 124 can be changes in accordance with different requirements, such as the angle at which the cover member 50 should be restricted with respect to the base member 10.

As shown in FIGS. 5A and 5B, in which the toolbox 100 is illustrated in its closed position, the sliding end 114 is maximally distanced from the recess engagement portion 126. In operation, when the toolbox 100 is converted from its closed position to its open position, the pivoting portion 112 of the stopping element 111 is rotated within the hinge portion 122, while the hinge portion 122 applies a pressing force on the pivoting portion 112. This results in a sliding movement of the sliding ends 114 and 116 slide within their respective longitudinal recesses 124, which is terminated when the sliding ends 114 and 116 engage with and stopped by their respective recess engagement portions 126, thereby restricting the angle between the cover member 50 and the base member 10.

The invention claimed is:

1. A toolbox, comprising:

a base member, made of a substantially rigid material, having base side walls extending from a base bottom to a perimetric base rim, and defining together a base interior storage space, said base bottom and base side walls configured with a base interior surface and a base exterior surface;

a cover member, made of a substantially rigid material, having a perimetric cover rim, a cover interior surface and a cover exterior surface, said cover rim corresponding in shape and size to fit said base rim; and a liner member having a liner interior surface and a liner exterior surface, said liner member being made of a rigid though pliable material;

said liner member being configured to be received within and supported by the base member in a spaced apart relationship therebetween so as to allow the liner member to be deformed towards the base interior surface, and wherein said liner member is configured to be received within the base member so that the liner exterior surface partially engages the base interior surface with one or more chambers formed therebetween, each of said chambers being configured with a chamber wall, constituted by a corresponding portion of the liner member, configured to be deformed towards the base interior surface, thereby reducing the volume of the respective chamber.

2. The toolbox according to claim 1, further comprising a plurality of supports disposed between the liner member and the base member for providing the spaced apart relationship between the liner exterior surface and the base interior surface.

3. The toolbox according to claim 1, wherein the liner member comprises a plurality of flexible legs extending out of the liner exterior surface, configured to lean on the base interior surface and to provide a support when a force is applied on the liner interior surface.

4. A toolbox, comprising:

a base member, made of a substantially rigid material, having base side walls extending from a base bottom to a perimetric base rim, and defining together a base interior storage space, said base bottom and base side walls configured with a base interior surface and a base exterior surface;

a cover member, made of a substantially rigid material, having a perimetric cover rim, a cover interior surface and a cover exterior surface, said cover rim corresponding in shape and size to fit said base rim; and a liner member having a liner interior surface and a liner exterior surface, said liner member being made of a rigid though pliable material;

said liner member being configured to be received within and supported by the base member in a spaced apart relationship therebetween so as to allow the liner member to be deformed towards the base interior surface, and wherein said liner is configured with a liner rim corresponding in shape and size to the base rim for securely resting thereon, so that in a closed position of the toolbox, the liner rim is clamped between the base rim and the cover rim, thereby sealing the toolbox.

5. The toolbox according to claim 1, wherein the material of the liner member is at least one of the following: Polyethylene, and a combination of a Linear Low-Density (LLD) Polyethylene and a Low-Density (LD) Polyethylene, and wherein the material has a shore A hardness of from about 55 to about 100.

6. The toolbox according to claim 1, wherein the cover member is further configured with cover side walls extending from a cover bottom to the perimetric cover rim, and defining together a cover interior storage space, the cover side walls and the cover bottom are configured with the cover interior surface and the cover exterior surface and wherein the toolbox further comprises an additional liner member having an additional liner interior surface and an additional liner exterior surface corresponding in size and shape to the cover interior surface, so as to allow the cover member to receive the additional liner member therein.

7. The toolbox according to claim 1, wherein the cover member is further configured with cover side walls extending from a cover bottom to the perimetric cover rim, and defining together a cover interior storage space, the cover side walls and the cover bottom are configured with the cover interior surface and the cover exterior surface and wherein the toolbox further comprises an additional liner member having an additional liner interior surface and an additional liner exterior surface corresponding in size and shape to the cover interior surface, so as to allow the cover member to receive the additional liner member therein, wherein the additional liner member is made of a rigid though pliable material.

8. The toolbox according to claim 7, wherein the additional liner member is configured to be received within and supported by the cover member in a spaced apart relationship between the additional liner exterior surface and the cover interior surface so as to allow the additional liner member to be deformed towards the cover interior surface.

9. The toolbox according to claim 1, further comprising a restricting mechanism configured to support the cover with respect the base member in an open position of the toolbox.

10. The toolbox according to claim 1, further comprising a restricting mechanism configured to support the cover with respect the base member in an open position of the toolbox and wherein the restricting mechanism is configured to restrict the angle between the cover member and the base member in the open position of the toolbox.

11. The toolbox according to claim 1, further comprising a restricting mechanism configured to support the cover with respect the base member in an open position of the toolbox wherein the restricting mechanism is configured with a stopping element having a pivoting portion pivotally received with a hinge portion of the cover member and at least one sliding end disposed within at least one corresponding recess formed within the base member and configured to slide within the recess between the open and the closed positions of the toolbox and wherein the recess within the base member has a longitudinal shape having a recess engagement portion on which the respective sliding end rests in the open position of the toolbox.

12. A toolbox, comprising:

a base member;

a cover member pivotally articulated to the base member, the toolbox has an open position in which the base member is pivotally disengaged from the cover member and a closed position in which the base member is engaged with the cover member; and a restricting mechanism configured to restrict the angle between the cover member and the base member in the open position of the toolbox and to support the cover with respect the base member in this position of the toolbox, and wherein the restricting mechanism is configured with a stopping element having a pivoting portion pivotally mounted to a hinge portion of the cover member and at least one sliding end disposed within at least one corresponding recess formed within the base member, the sliding end is configured to slide within the recess between the open and the closed positions of the toolbox.

13. The toolbox according to claim 12, wherein the restricting mechanism is configured with a stopping element having a pivoting portion pivotally mounted to a hinge portion of the cover member and at least one sliding end disposed within at least one corresponding recess formed within the base member, the sliding end is configured to slide within the recess between the open and the closed positions of the toolbox and wherein the recess has a longitudinal shape.

14. The toolbox according to claim 9, wherein the restricting mechanism is configured with a stopping element having a pivoting portion pivotally mounted to a hinge portion of the cover member and at least one sliding end disposed within at least one corresponding recess formed within the base member, the sliding end is configured to slide within the recess between the open and the closed positions of the toolbox and wherein the recess has a recess engagement portion on which the respective sliding end rests in the open position of the toolbox.

15. The toolbox according to claim 1, wherein the material of the liner member is water impermeable.

16. The toolbox according to claim 5, wherein the material of the liner member has a shore A hardness of from about 70 to about 90.

* * * * *